United States Patent [19]

Bourque

[11] Patent Number: 4,674,202

[45] Date of Patent: Jun. 23, 1987

[54] CROSS-COUNTRY SKI BOOT

[75] Inventor: Rene Bourque, Duvernay, Canada

[73] Assignee: Warrington Inc., Lachine, Canada

[21] Appl. No.: 832,433

[22] Filed: Feb. 24, 1986

Related U.S. Application Data

[62] Division of Ser. No. 562,012, Dec. 16, 1983, abandoned.

[51] Int. Cl.[4] ..... A43B 13/38; A43B 5/04

[52] U.S. Cl. ..... 36/43; 36/117; 36/76 R

[58] Field of Search ..... 36/43, 117, 76 R, 76 C, 36/107, 108, 14, 44

[56] References Cited

U.S. PATENT DOCUMENTS

| | | | |
|---|---|---|---|
| 2,259,322 | 10/1941 | Parkhurst | 36/76 R |
| 4,186,500 | 2/1980 | Salzman | 36/117 |
| 4,245,406 | 1/1981 | Landay | 36/14 |
| 4,541,184 | 9/1985 | Leighton | 36/44 |

FOREIGN PATENT DOCUMENTS

| | | | |
|---|---|---|---|
| 657423 | 2/1963 | Canada . | |
| 29206 | 5/1981 | European Pat. Off. | 36/117 |
| 96094 | 12/1983 | European Pat. Off. | 36/117 |
| 2001297 | 10/1970 | Fed. Rep. of Germany | 36/117 |
| 2645007 | 4/1978 | Fed. Rep. of Germany | 36/117 |
| 1216879 | 4/1960 | France | 36/76 R |
| 1417011 | 9/1965 | France | 36/76 R |
| 2478441 | 9/1981 | France | 36/117 |

*Primary Examiner*—Werner H. Schroeder
*Assistant Examiner*—Steven N. Meyers
*Attorney, Agent, or Firm*—Schwartz, Jeffery, Schwaab, Mack, Blumenthal & Evans

[57] ABSTRACT

A sole insert for use in footwear includes a toe plate portion, a metatarsal portion and a heel portion all formed in an integral molded member. The heel portion includes a thickened block-type reinforcing frame merging smoothly into a similarly constructed-type metatarsal portion of reduced thickness which in turn merges into the flat toe portion. The toe portion includes laterally extending weakened portion such that the insert will resist to torsional twisting but will flex about a lateral axis located in the toe portion.

2 Claims, 5 Drawing Figures

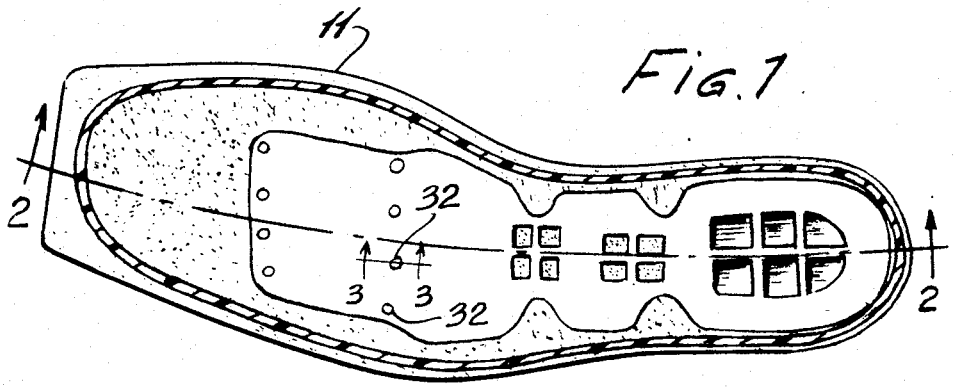
FIG. 1
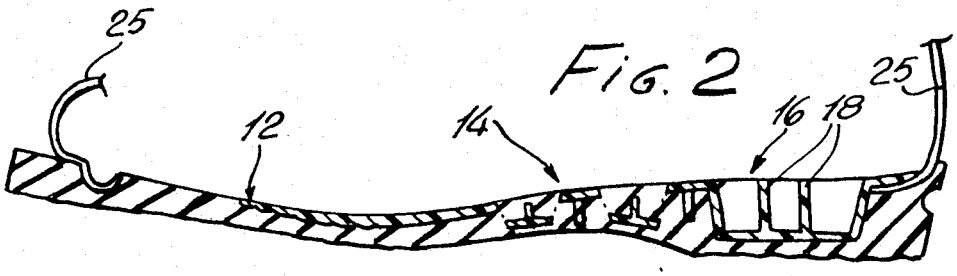
FIG. 2
FIG. 3
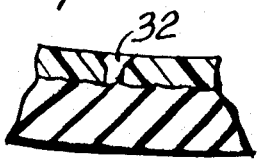

CROSS-COUNTRY SKI BOOT

This is a, division, of application Ser. No. 562,012, filed Dec. 16, 1983 abandoned.

BACKGROUND OF THE INVENTION

1. Field of the Invention

The present invention relates to footwear and more particularly to an insole insert especially for use in cross-country ski boots.

2. Description of the Prior Art

An important feature of a cross-country ski boot is to provide a sole which will resist torsional rotation or twisting along the longitudinal axis of the boot but yet provides sufficient flexing of the boot along a lateral axis in the toe area of the boot. As is well known, most cross-country ski bindings are attached to the sole of the ski boot only in the toe area and therefore the remainder of the boot including the heel is unattached and free to move in any direction. In order to provide efficient skiing, and to ensure that the heel always comes down on the ski, it is imperative that the sole be relatively rigid in the heel and metatarsal areas.

SUMMARY OF THE INVENTION

The present invention provides an insole insert made of molded material and having a toe area, a metatarsal area and a heel area. The metatarsal and heel areas are a rigid structure and are formed with the toe plate so as to prevent torsional rotation or twisting. The toe plate member includes a number of laterally extending weakened areas allowing the sole to pivot or bend about a lateral axis in the toe area without reducing the resistance to twist.

BRIEF DESCRIPTION OF THE DRAWINGS

Having thus generally described the nature of the invention, reference will now be made to the accompanying drawings, showing by way of illustration, a preferred embodiment thereof, and in which:

FIG. 1 is a top plan view partly in cross-section looking down at the inside of a cross-country ski boot;

FIG. 2 is a vertical longitudinal cross-section taken along lines 2—2 of FIG. 1;

FIG. 3 is a vertical cross-section taken along lines 3—3 of FIG. 1;

DESCRIPTION OF THE PREFERRED EMBODIMENTS

Figure 4:
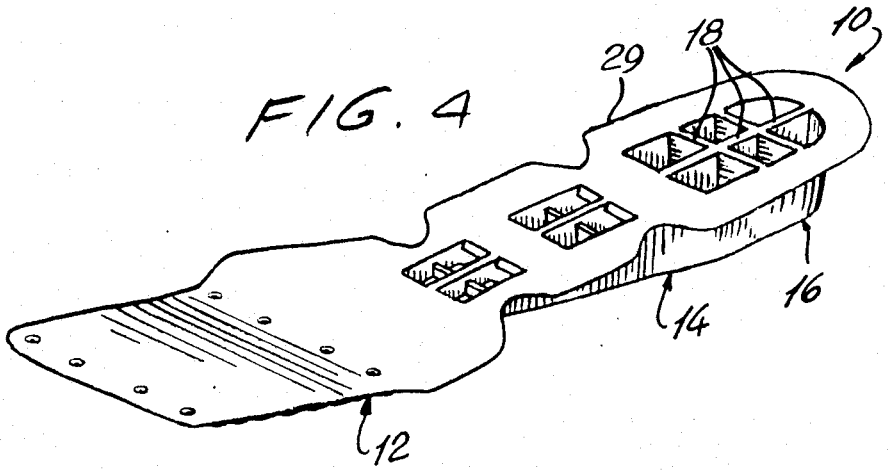
FIG. 4 is a perspective view of the sole insert in accordance with the present invention.
Figure 5:
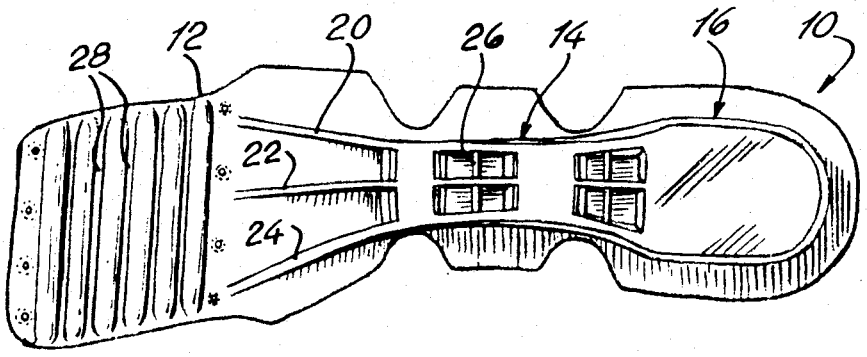
FIG. 5 is a bottom plan view thereof.

Referring now to the drawings and particularly to FIGS. 4 and 5, a molded insert for use in a construction of a cross-country ski boot sole is shown in which the insert 10 is molded in one integral piece having a toe plate portion 12, a metatarsal portion 14 and a heel portion 16. The top of the insert 10 has a relatively smooth flat surface merging into an enlarged toe plate 12.

The heel portion 16 includes openings defining a quadrilateral frame structure including downwardly extending wall members 18 acting to reinforce the heel portion. The insert narrows and reduces in thickness as it extends through the metatarsal portion 14 and includes, near the toe portion in the form of three ribs 20, 22 and 24. Cross members 26 are provided between these ribs in the area of the metatarsal portion 14. The box frame or reinforcement portion of the metatarsal and heel portions are open towards the bottom as shown in FIG. 5 and towards the top surface as shown, for purposes of reducing the weight of the insert and also to anchor the material which will be molded around the insert to form the sole 11 as will be described later. Finally, the insert 10 includes an outwardly extending flange surrounding the periphery thereof. The toe portion 12 includes a plurality of weakened linear sections or grooves 28 which allow the toe portion to flex in a longitudinal direction about a lateral axis.

In construction, a manner of utilizing the insert is to allow the skirt of the upper 25 to be attached underneath the flange 29 of the peripheral flange 29 of the insert and then the sole 11 may be formed thereabout by way of injection molding a plastics material, thereby anchoring the upper 25 to the under side of the flange 29 and fixing the insert in the so-formed sole 11 as shown in FIGS. 1 and 2. The openings formed in the bottom of the insert allow the plastics material to flow therein and anchor the insert when the materials have cooled and solidified. The manner of attaching the upper 25 to the insert is by normal last construction utilizing a string to pull in the depending skirts of the upper 25. Theoretically, the insert could replace the last as it is sufficient to receive the downwardly extending skirts of the upper 25 and thereby pull the strings in a conventional manner.

The toe area of the sole insert will also be provided with openings to allow material of the sole 11 to enter thereby anchoring the tow to the sole 11. Such an opening 32 is shown in FIG. 3.

I claim:

1. A one-piece insert for a molded sole in a cross-country ski boot, the insert including a toe portion, a metatarsal portion, and a heel portion, a thickened block-type reinforcing frame having longitudinally extending ribs and laterally extending reinforcing cross members in the heel and metatarsal portions, the block-type frame tapering smoothly into a flat toe portion, a peripheral flange extending about the reinforcing frame and defining the plane of the sole to be molded thereon, the flange including an upper receiving undersurface, the toe portion including a laterally extending weakened portion, said insert, when integrated in the molded sole, providing resistance to torsional twisting but flexibility about a lateral axis located in the toe portion.

2. A one-piece insert as defined in claim 1, wherein the block-type reinforcing frame in the heel portion of the insert includes a closed-off bottom defining deep-seated recesses with the intersecting lateral and longitudinal ribs and cross members, the thickened block-type reinforcing frame in the metatarsal portion being open top and bottom and defining through passages with the intersecting ribs and cross members, the block-type reinforcing frame thus providing means for anchoring molded plastics material when the sole is being molded to the insert, and providing a stiff rigid heel and relatively rigid metatarsal portion while allowing flexibility about a lateral axis in the toe portion.

* * * * *